US005680824A

United States Patent [19]

Kemter et al.

[11] Patent Number: 5,680,824

[45] Date of Patent: Oct. 28, 1997

[54] PROCESS FOR BURNING SOLIDS WITH A SLIDING FIREBAR SYSTEM

[75] Inventors: Andreas Kemter, Radolfzell; Thomas Nikolaus, Allensbach, both of Germany; Jakob Stiefel, Volketswil, Switzerland

[73] Assignee: Techform Engineering AG, Switzerland

[21] Appl. No.: 532,675

[22] PCT Filed: Feb. 6, 1995

[86] PCT No.: PCT/CH95/00026

§ 371 Date: Dec. 6, 1995

§ 102(e) Date: Dec. 6, 1995

[87] PCT Pub. No.: WO95/21353

PCT Pub. Date: Aug. 10, 1995

[30] Foreign Application Priority Data

Feb. 7, 1994 [CH] Switzerland ..... 342/94
Apr. 28, 1994 [CH] Switzerland ..... 1321/94

[51] Int. Cl.[6] ..... F23L 1/00

[52] U.S. Cl. ..... 110/348; 110/188; 110/257; 110/285; 110/291; 110/101 A; 110/101 C

[58] Field of Search ..... 110/101 A, 101 C, 110/186, 188, 268, 270, 273, 274, 281, 282, 290, 291, 348, 257, 258, 346; 126/175; 432/77, 78

[56] References Cited

U.S. PATENT DOCUMENTS

| | | | |
|---|---|---|---|
| 4,275,706 | 6/1981 | Pauli | 110/168 X |
| 4,471,704 | 9/1984 | John et al. | 110/257 X |
| 4,838,183 | 6/1989 | Tsaveras et al. . | |
| 5,142,999 | 9/1992 | Etemad et al. . | |
| 5,197,397 | 3/1993 | Yamagishi et al. | 110/282 X |

FOREIGN PATENT DOCUMENTS

| | | |
|---|---|---|
| 9309198 | 9/1993 | Germany . |
| 1049819 | 6/1989 | Japan . |
| 2106613 | 7/1990 | Japan . |
| 2110209 | 7/1990 | Japan . |
| 9009552 | 8/1990 | WIPO . |

OTHER PUBLICATIONS

Von M. Busch et al., "Entwicklung Einer Kameragefuhrten Feuerungsregelung Zur Verbesserung Des Verbrennungs—, Ausbrand— und Emissionsverhaltens Einer Abfall–Verbrennungsanlage", VGB Kraftwerkstechnik 73 (1993) Juli, No. 7, Essen, DE.

*Primary Examiner*—Henry A. Bennett
*Assistant Examiner*—Susanne C. Tinker
*Attorney, Agent, or Firm*—Speckman, Pauley & Fejer

[57] ABSTRACT

A process for burning solids on a sliding fire grate system where each of the combustion control criteria are measured and controlled individually for each grate plate comprising the grate system.

19 Claims, 8 Drawing Sheets

PROCESS FOR BURNING SOLIDS WITH A SLIDING FIREBAR SYSTEM

BACKGROUND OF THE INVENTION

1. Field of the Invention

This invention relates to a process for burning solids on a sliding fire grate system. The solids can be any combustible solids, for example fossil fuels such as soft coal, hard coal and the like materials. The process is particularly suited for burning refuse or garbage in large installations, wherein, due to the invention, combustion is optimized in many ways. A novel type of sliding fire grate system is necessary for operation of this process, which is first described here in order to later explain the process executed by it.

2. Description of Prior Art

In contrast to conventional fire grates, the grate stages of which are constructed from a plurality of grate bars lined up next to each other and made of cast chrome steel, the grate stage of the novel sliding fire grate disclosed herein comprises a hollow grate plate made, for example, of two sheet steel shells welded together. A suitable medium can flow through the individual grate plates by means of one or several liquid circuits and can be maintained at the desired temperature in this way. Thus, it is possible to maintain the grate at a low temperature by cooling or, if required, to preheat it. Water is preferably used as the medium for cooling or heating. A further distinction over the conventional fire grates lies in the options for sliding movements of the grate. With conventional sliding fire grates, every other grate stage is movable, while the others are installed stationary. However, the movable grate stages are fixedly connected to each other and therefore can only perform a parallel movement, i.e. either all movable stages do not move or all move forward and back together. The strokes are approximately 150 mm to 400 mm, depending on the model. Thus a conveying motion of the material to be burned on the grate is connected, without exception and necessarily, with the movement of these grate stages of the conventional sliding grates. With the novel sliding grate disclosed herein, every other grate stage is also designed to be movable, however, in contrast to conventional sliding grates, each one of these movable grate stages can be individually moved, namely in relation to the direction of the stroke, the stroke travel and the stroke speed. As a third essential difference from conventional grates of chrome steel grate bars, the novel grate disclosed herein can be provided with hollow grate stage plates with a plurality of feed nozzles for the primary air supply of the fire. This novel grate construction provides new options for the control and regulation of the combustion.

SUMMARY OF THE INVENTION

It is therefore an object of this invention to provide a process for the combustion of solids in such a sliding fire grate system which is able to optimize the combustion process in many ways. The process in particular includes a number of control and regulating measures which assure that the combustion chamber spectrum can be brought closer to an ideal spectrum and kept close to it during operation, so that a further optimized final burning of all combustion residues is achieved, as a result of which boiler efficiency can be increased and boiler erosion can be reduced and wherein furthermore the flue gas values, in particular the CO and $NO_x$ portions thereof, can be further reduced and, in this way, the steps for downstream flue gas processing can be made less elaborate.

This object is attained in accordance with this invention by a process for the combustion of solids on a sliding fire grate system comprising a plurality of grates, through each of which a cooling medium flows separately, and half of which are individually movable grate stages cooling each of said grates, supplying primary air individually and timed to each of said grates, applying stoking movements individually and timed to each of said grates, applying conveying movements individually and timed to each of said grates and applying feeding movements timed to each of said grates to feed said grate system. If necessary, combustion-enhancing materials may be directly metered into said primary air or said primary air may consist exclusively of such materials. The cooling fluid temperatures of the individual grates are used as control variables for control of the process.

BRIEF DESCRIPTION OF THE DRAWINGS

The process of this invention will be better understood from the following description taken in conjunction with the drawings, wherein.

DETAILED DESCRIPTION OF PREFERRED EMBODIMENTS

Figure 1:
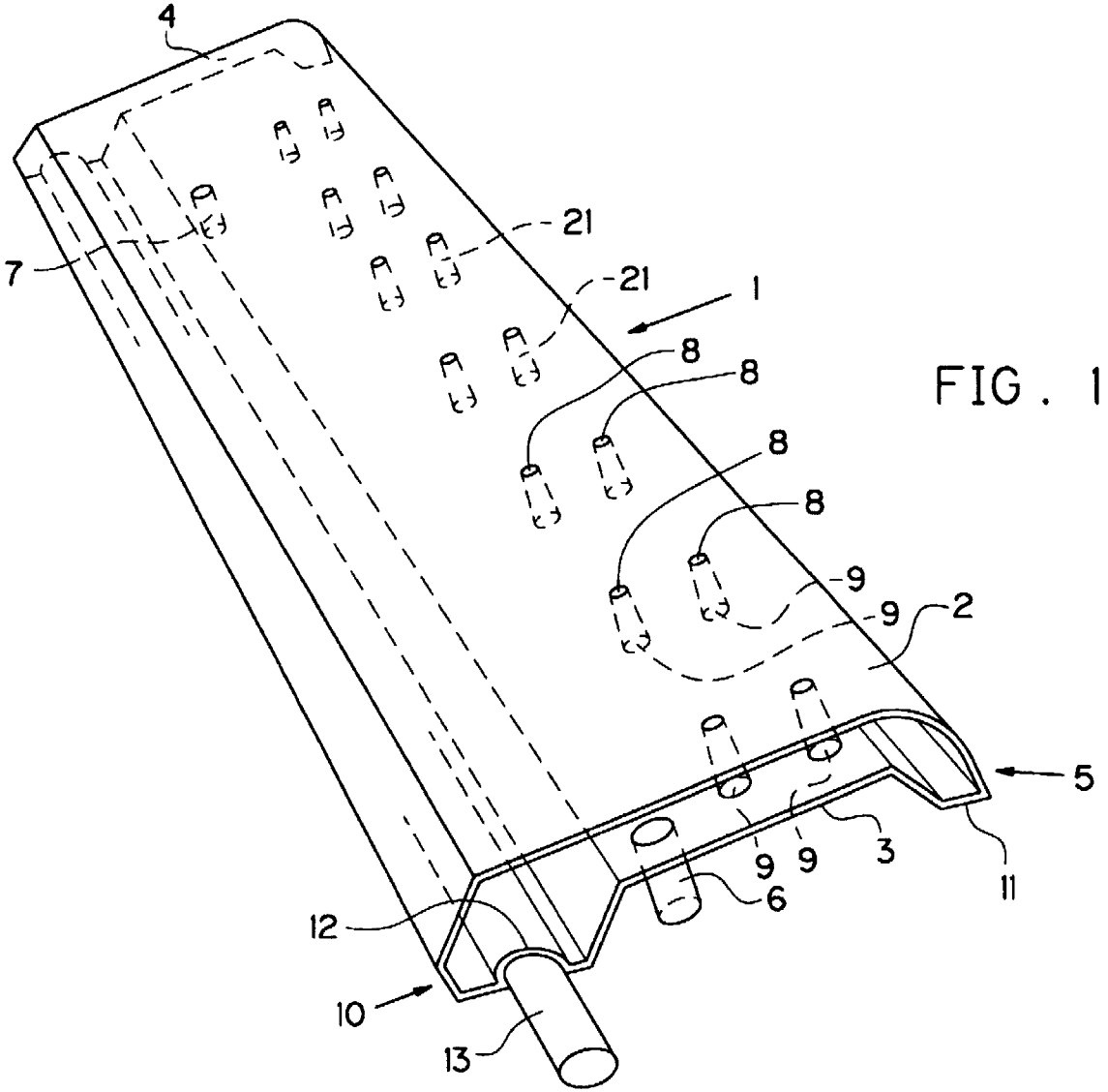
FIG. 1 shows a single grate stage of a sliding fire grate employed in the process of this invention in the form of a water-cooled grate plate.

A single grate plate I of a fire grate having a circuit for cooling or generally for changing the temperature is shown in a perspective view in FIG. 1. This embodiment of a grate plate I comprises two chrome sheet steel shells, namely a shell for the grate plate top 2 and a shell for the grate plate bottom 3. The two sheet steel shells 2, 3 are welded together. To do this, their edges are advantageously shaped in such a way that the two shells 2, 3 can be slightly slipped into each other by their edges. The two fronts of the hollow profile created in this way are tightly welded together by end plates. In the drawing, the rear end plate 4 has been inserted, while the front end is still open and permits a view of the interior of the hollow profile. After closing both front ends, a hollow chamber, sealed against the outside, is formed in the interior of the grate plate 1. Two connectors 6, 7 for connecting of a feed and return line for a medium flowing through the grate plate i are located on the grate plate underside 3. This medium is basically used for maintaining the grate plate i at the desired temperature and basically is a flowable medium, that is a gas or a liquid. It is therefore possible, for instance, for a cooling liquid to flow through the grate plate 1. The cooling liquid can be, for example, water or oil or another liquid suitable for cooling. On the other hand, a liquid or a gas may be employed for heating the grate plate 1. Depending on the medium selected, this can be used as required for cooling as well as for heating, that is generally for placing the grate plate 1 at the desired temperature. Openings 8, 9 are formed by grate plate top 2 and grate plate underside 3. The openings 8 on the top 2 are narrower than the openings 9 on the underside 3. The openings 8, 9, which are generally aligned with each other on the grate plate top 2 and the grate plate underside 3 are connected to each other by tube-shaped elements 21, for example conical tubes of a circular, elliptical or slit-shaped diameter, wherein each one of these elements 21 is securely welded into the grate plate top 2 and the grate plate underside 3. By the flow-through of air from the direction of the grate plate underside 3, the funnel-shaped passages through the grate plate 1 created in this way allow a directed aeration of the material to be burned lying on the grate. For this purpose, supply tubes or hoses for the primary air to be blown in are connected to the individual ends of the continuous tubes on the underside 3 of the grate plate 1. The grate plate 1 represented here has such a cross section that a largely flat surface is formed on the top 2 of the plate 1. The lower side 3 has edges whereby bases 10, 11 are formed. Along one base 10, which is shown forming a channel 12, a round rod 13 on which the grate plate I rests extends into the interior of this channel 12. The other base 11 is flat on the bottom and intended for resting on the adjoining grate plate, which has the same shape.

Figure 2:
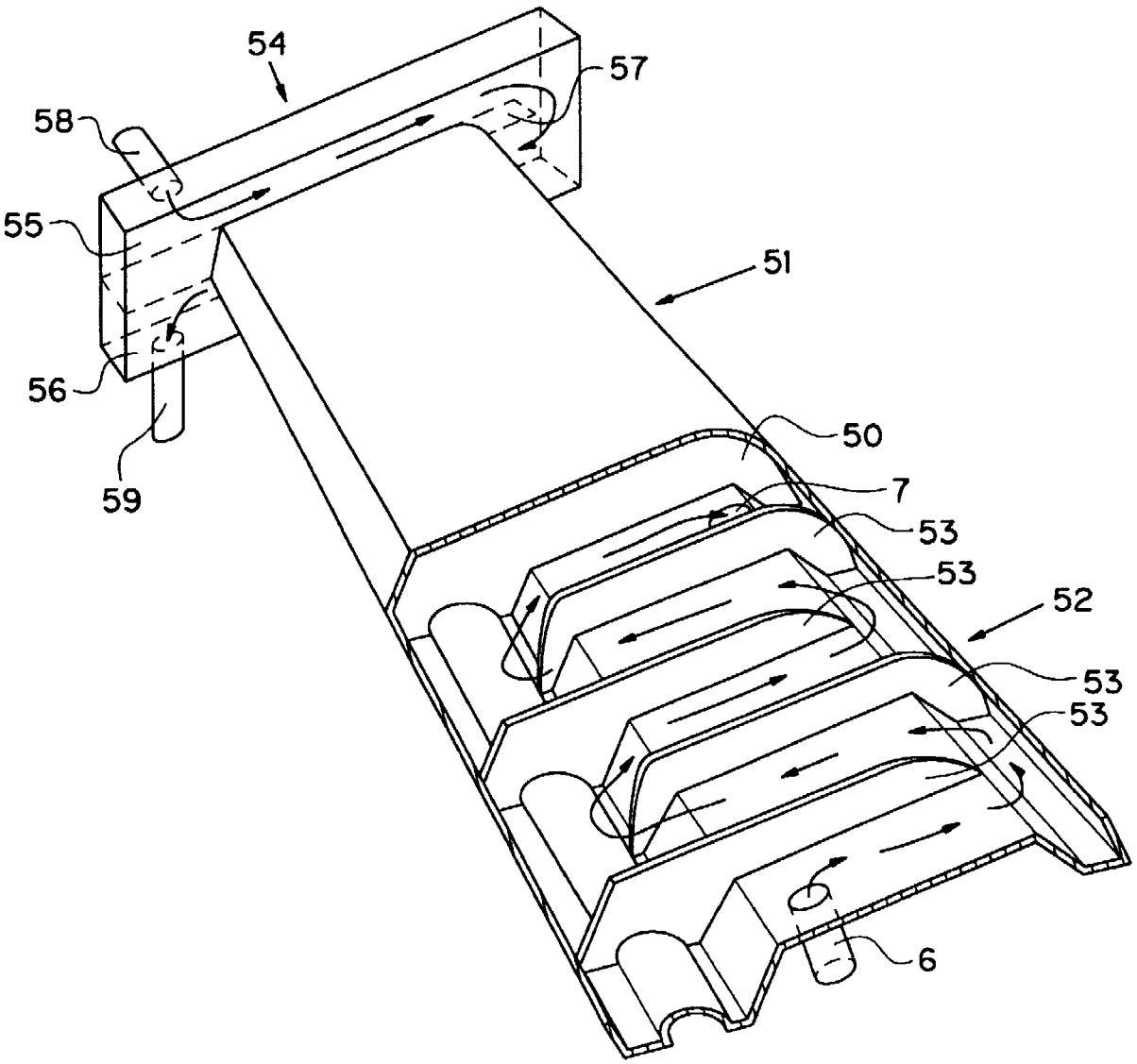
FIG. 2 is a partial cross-sectional view of a single grate plate of a fire grate with baffles.

A grate plate 1 is shown in partial section in FIG. 2. This grate plate is divided into two chambers 51, 52 by a partition 50. This grate plate is one which is installed in the first part of a fire grate in which primary air is not used, for which reason the plate here shown, in contrast to the one in FIG. 1, does not contain tube-shaped elements and therefore has no openings. As a rule, fire grates consist of three to five different zones, each consisting of several grate plates, wherein primary air is supplied only starting at the second zone. Baffles 53 have been installed in the interior of the two chambers 51, 52 and are tightly welded to the grate plate at the bottom, while leaving an air gap of a few tenths of a millimeter open at the top towards the inside of the top of the grate plate, so that by means of these air gaps a gas exchange can take place inside the labyrinth formed by the baffles 53. A cooling medium is pumped into the grate plate chamber 52 through the connector 6, which then flows as shown by the arrows through the labyrinth formed by the baffles 53 and finally flows out of the chambers again through the connector 7. Since in this way a larger surface for taking up heat is provided for the cooling medium during the flow-through, a better heat exchange is achieved. Water, for example, can be used as cooling medium. The interior of the chamber 51 looks exactly the same. It is of course also possible for such a grate plate with an interior labyrinth to be interspersed by tube-shaped elements so that openings for blowing through primary air are provided. Planks 54 are disposed on both lateral edges of the grate plate, along which the movable grate plates move back and forth. In the example illustrated, each plank 54 consists of two superimposed square tubes 55, 56, wherein the intermediate wall 57 formed in this way is shortened at one end, so that a connection between the interior of the two square tubes 55, 56 is formed there. Cooling medium is pumped from a connector 58 through the plank 54, which then flows through the two square tubes 55, 56 as indicated by the arrows and finally flows out of the plank 54 again through the connector 59. In addition it is possible to dispose a shielding plate, not shown here, between the plank 54 and the grate plate, which encloses the plank 54 on the side of the combustion plate and is used as a wear element because of the friction occurring between the grate plate and the plank.

While the inflow for all grate plates to be placed at the right temperature or to be cooled can be combined into a single mutual line, the outflows of the cooling water from each grate plate are conducted separately and, if the grate plates are divided by a partition into two or more separate cooling chambers, the result will be two or even more outflows per grate plate. Common plumbing pipes can be used for these outflows, since the temperatures to be withstood permit this without problems.

The flow-through is separately measured for each cooling chamber by a flow-through measuring device in the individual outflows and is separately controlled by a valve for each individual outflow. It is possible in this way to distribute the cooling medium specifically. If this valve is completely closed, the flow-through is interrupted, if it is completely open, there is maximum flow-through for the supplied medium. It is possible to vary infinitely between these two extreme settings. The valves in the individual outflows can be remotely controlled by servo motors. It is possible in this way to individually regulate the coolant flow-through for each cooling chamber. The cooling medium inflow can be controlled by a separate metering unit. It is also possible to optionally feed this supplied cooling medium through a heating system in order to preheat the grate to the desired operating temperature for starting the installation.

Figure 3:
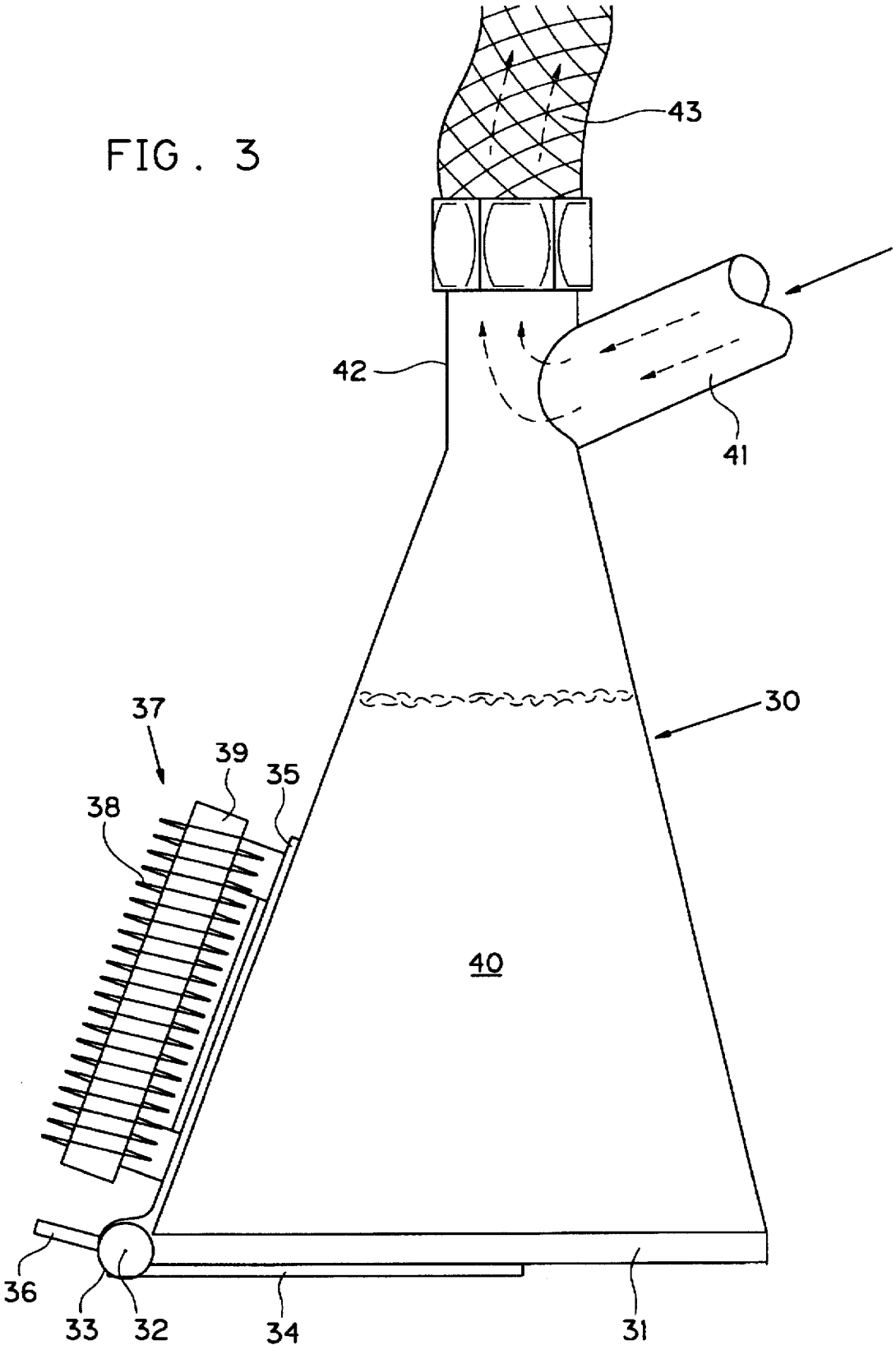
FIG. 3 shows an air supply trap for installation underneath the fire grate, with a container for materials falling through the grate and a device for its remote-control emptying.

FIG. 3 shows a supply trap 30 such as can be mounted underneath the fire grate for each primary air supply line. Because a little material can inevitably fall down through the small openings in the grate plates, this material falling through the grate in the form of finely-grained slag falls into the supply lines for the primary air. For this reason it is necessary to provide such supply traps 30, in which the material falling through the grates is caught and by which simultaneously the unimpeded supply of air is assured. Such a trap is designed similar to the shape of an Erlenmayer flask, for example, wherein the bottom of the trap is closed by a spring-loaded flap 31. The flap 31 is pivotable around a hinge 32, and with its one leg 34 a spring 33 acts upon the flap 31 from below and with the other leg 35 upon the lateral wall of the trap. An actuating lever 36 fixedly connected to the flap 31 extends away from the hinge 32 and is within the area of action of a solenoid 37. When its coil 38 is charged with electric voltage, this electromagnet pulls the actuating lever 36 against its core 39, by means of which the flap 31 is opened and the collected materials 40 which had fallen through the grate fall into a collecting trough located underneath it. The primary air supply line 41 leads into the interior of the trap 30 in the upper region of the trap 30. This supply line leads downwardly inclined into the trap so that material which had fallen through the grate can under no circumstances fall into this supply line, because a strong air flow does not necessarily pass through the latter all the time. The neck 42 of the trap is connected via a heat-resistant flexible line 43 with the lower mouth of a single conical tube leading through the grate plate 1.

A ventilation conduit which is central to the entire grate and extends in the longitudinal direction underneath the grate is used as the supply conduit for the primary air. Hoses branch off laterally from it, lead to the underside of the grate plates and are there connected with appropriate openings which conically pass through the grate plates from above. The flow of air from the direction of the grate plate underside allows the directed airing of the materials lying on the grate to be combusted.

As already described in FIG. 3, the primary air supply is blown through individual hoses from the supply conduit through the traps to the individual small air tubes which pass through the grate. These hoses are also provided with controllable valves, for example solenoid valves. This embodiment permits a very specific and individual control of the primary air for a large number of separate small areas of the grate. In this way, it is possible to control the fire very specifically and therefore to operate a practically geometric fire.

Figure 4:
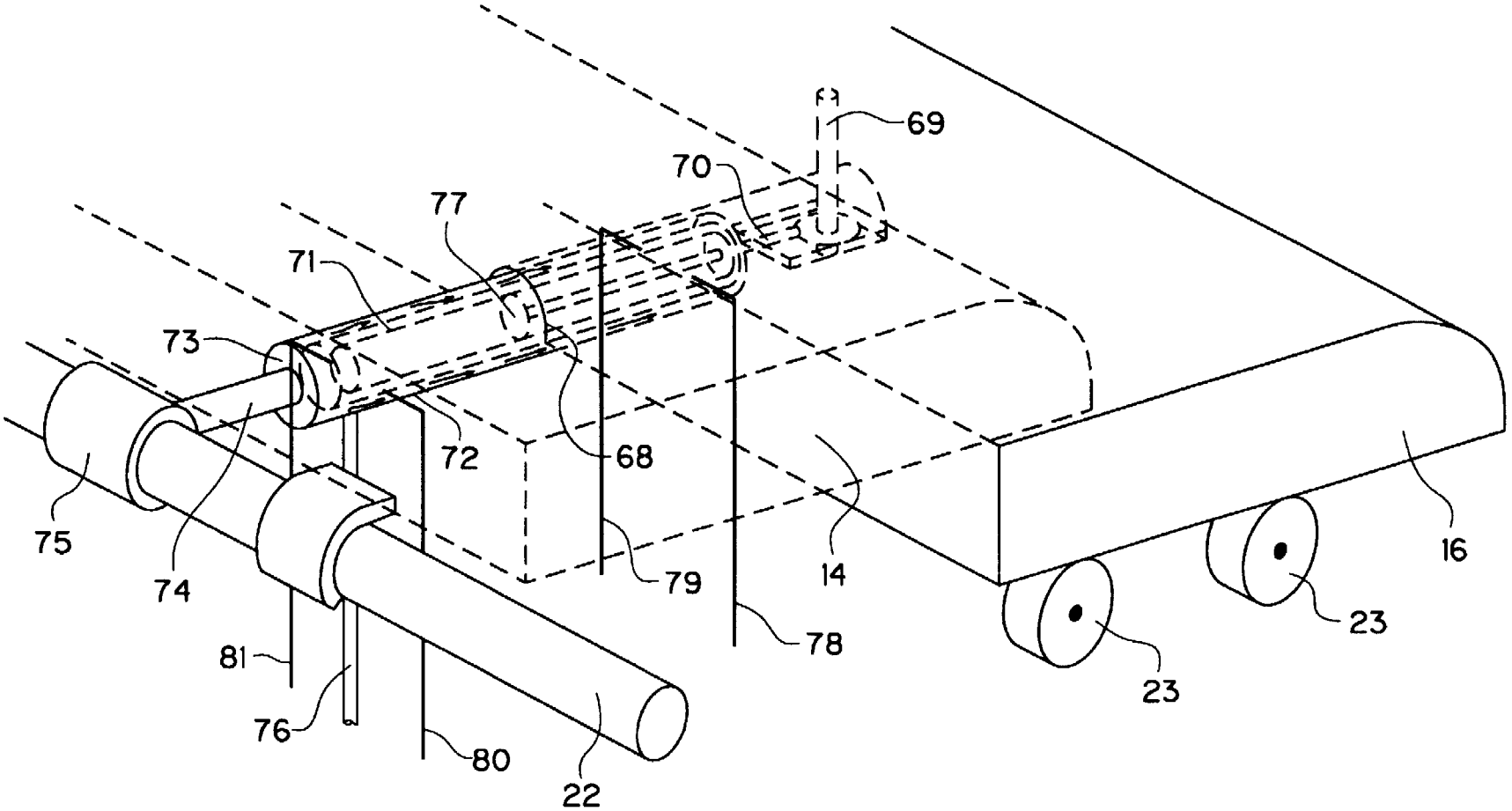
FIG. 4 is a perspective view of the grate stage drive of an individual grate plate.
Figure 5:
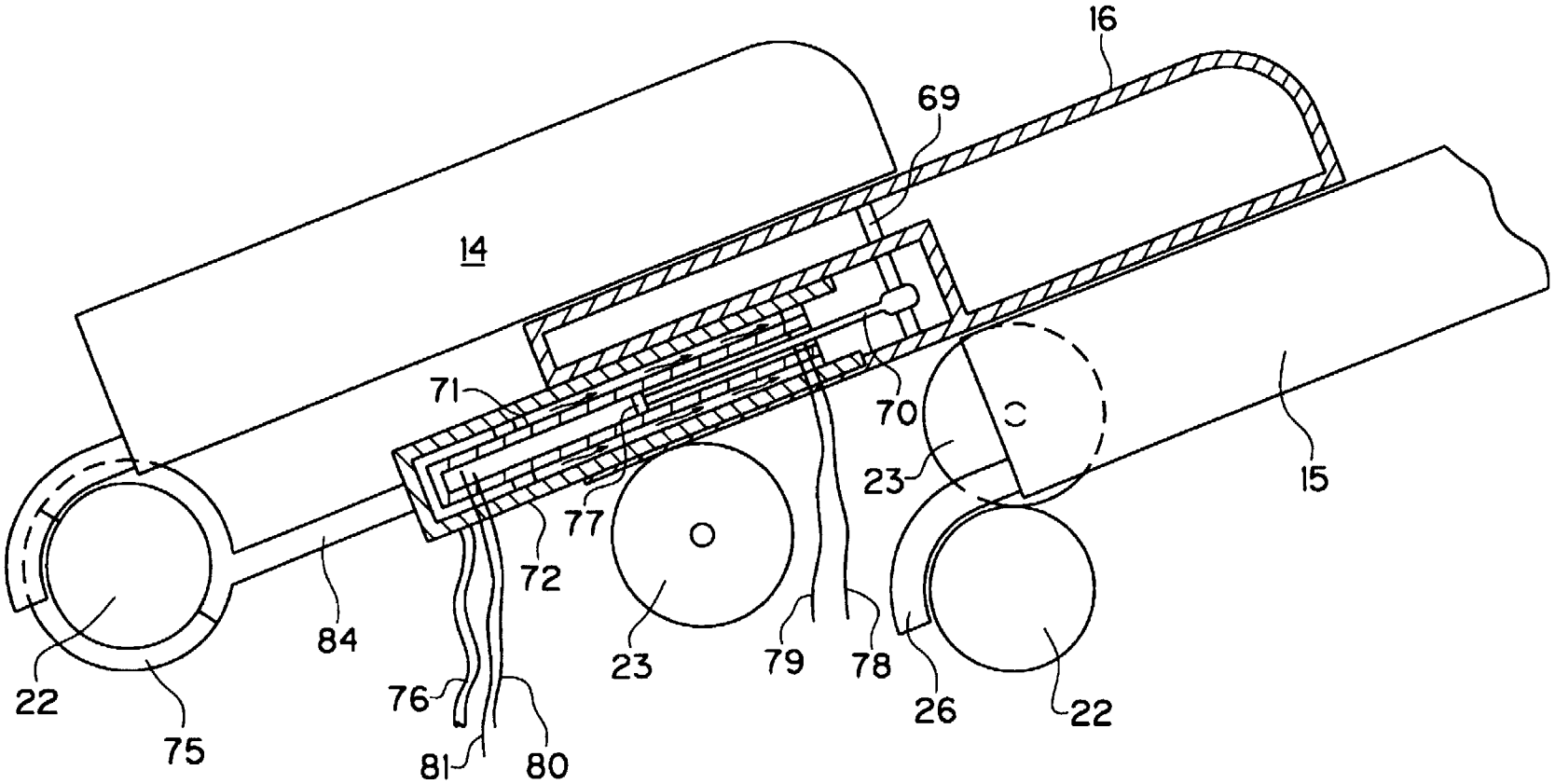
FIG. 5 is a lateral cross-sectional view of the grate plate drive.

The drive of an individual movable grate plate is shown in detail in FIG. 4. The movable grate plate 16 laterally rests on respectively two steel rollers 23 seated on roller bearings and fastened on the lateral planks of the grate structure. A stationary grate plate 14 rests with its front edge on the movable grate plate 16 represented here and is shown in dashed lines. This stationary grate plate 14 is held on a steel pipe 22 by claws 26 on its back end as shown in FIG. 5. This steel pipe 22 is welded between the two planks of the grate path. The movable grate plate 16 has a semi-cylindrical recess 68 on its underside, which extends by approximately one half into the grate plate 16. A bolt 69, which can be maintained in a bushing which passes through the grate plate, extends through this recess. The piston rod 70 of a hydraulic piston-cylinder unit 71 is fastened on the bolt 69 and is fastened in the interior of a rinsing cylinder 72 which itself fits with its outside into the recess 68 and is fastened therein. The back of the rinsing cylinder 72 is fixedly connected by a rod 74 and a pipe clamp 75 to the steel pipe 22 which also holds the stationary grate plate 14 located over this entire drive. The rinsing cylinder 72 is continuously supplied with fresh air by an air supply line 76. As a result, air continuously flows through the rinsing cylinder 72 in the direction toward the bolt 69, by which a shell of pure air flows around the hydraulic piston-cylinder unit 71, which is contained in the rinsing cylinder 72, and as a result it is cooled and cannot become covered in dust from the direction of the open end in front. The hydraulic piston-cylinder unit 71 itself is supplied on both sides of the piston 77 with hydraulic fluid, which flows through it, by respectively one supply line 79, 81 and an associated return line 78, 80. Control of the hydraulic piston-cylinder unit 71 is then performed by blocking individual lines. Additional cooling is achieved by this permanent flow through the cylinder chamber. Due to the liquid cooling of the grate, the temperature underneath the grate never rises to the critical hydraulic fluid temperature of approximately 85° C. The cylinder-piston units 71 provided are operated at hydraulic pressures up to 250 bar, only contain about one liter of hydraulic fluid and thus provide up to 5 tons of thrust force, which is more than sufficient. The following rough calculation will demonstrate this: in a conventional grate, for example, approximately 100 tons of garbage are converted per grate path and day. The passage time here is approximately 20 minutes. This results in an instantaneous weight load of approximately 1.4 tons on the entire grate path. If this consists of, for example, 10 grate plates or grate stages, the result is a very small load of approximately 140 kg per grate plate. Even with a multiple load this would represent no problem at all for the drive. Each movable grate plate or grate stage can be controlled completely individually by means of the construction described here. Not only can it be determined whether and in what direction it is to be moved, but also at what speed. This can also be continuously regulated between zero and a maximum speed by the infinitely variable check valves.

FIG. 5 in addition shows the drive in cross section viewed from one side, wherein the same elements as were already described in FIG. 4 are represented. The movable grate plate here rests again on the next stationary grate plate 15 which itself is held on the steel pipe 22 with its back end by the claw 26. Depending on the layout, a grate of such overlapping grate plates can be horizontal, as shown, or raised upward in the conveying direction or inclined downward. In this case, the stroke length and grate plate inclinations provided can be selected in such a way that the strokes of the grate plates are only stoking movements. These are approximately ¼ to ⅓ of a normal conveying stroke. A conveying stroke is, for example, 250 mm, and the stroke frequency can vary between 0.5 Hz and 2 Hz. By purely stoking strokes, the material to be burned, which slowly moves downward on the grate plate surface because of gravity, is steadily pushed back a little and is repositioned in the process. This repositioning or stoking is very helpful to complete combustion. The material to be burned is therefore not pushed from the grate plate front onto the next plate during such stoking movement. Only when greater strokes are performed is the material to be burned conveyed as desired.

Thus, the essential material prerequisites for executing the present process are disclosed. Prior to describing the process of this invention in detail, the basic problems of combustion will first be explained by means of two diagrams.

Figure 6:
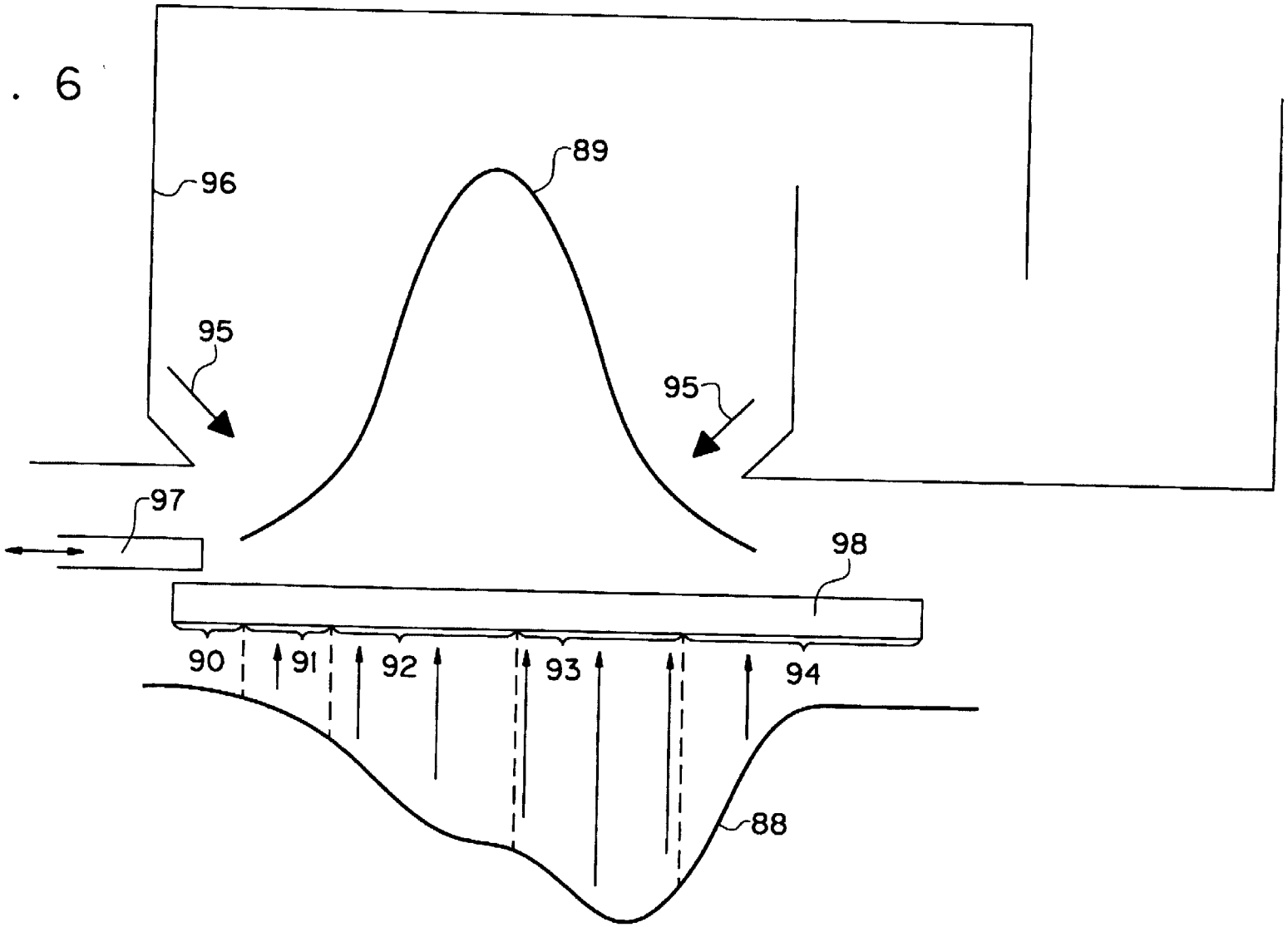
FIG. 6 shows the energy profile of an ideal garbage combustion.

FIG. 6 shows the energy profile 86 of an ideal garbage combustion, such as can only be approximated on a water-cooled grate. In this case, the energy curve 89 is a parabola and represents the product of temperature times flow-through of the cooling water. The various grate zones 90 to 94 with the distribution 88 of the primary air supply are indicated below the grate 98. The drying zone 90 is located at the very start of the grate, immediately behind the feed 97. Here, the material to be burned is first dried on the grate 98, which should take place without any primary air supply, if possible. However, with a conventional, non-water-cooled grate the air supply cannot be avoided, because it is needed to cool the grate. The fire is inevitably fanned by this air which is actually used as cooling air and then the cooling air inevitably also acts as the primary air. Therefore, of necessity, air is already added at the start of the grate of these conventional grates and therefore much too early. In the remaining area of the grate, air is often supplied in wrong amounts and in the wrong places, because it is not possible at all to meter specifically. But with the described water-cooled system of the grate system employed in the process of this invention, the functions of primary air supply and water cooling are principally and totally separated. It is, therefore, possible to operate the grate 98 in the drying zone without any supply of air. Cooling takes place exclusively by means of the water flowing through the grate 98. Ignition of the material to be burned takes place in a second zone 91. Here, primary air is supplied for the first time in a metered manner. The main combustion zone then follows, which is divided into two sections 92 and 93. Following this is the final combustion zone 93 extending to the end of the grate 98. As indicated in the diagram, the amount of primary air supplied over the first half of the grate length is practically steadily increased, reaches a maximum in the second main combustion zone 93 and then decreases rapidly. Air is supplied to the final combustion zone only when necessary, i.e. if there is anything to be burned. Secondary air is supplied laterally above the fire in order to assure the final combustion of the flue gas. The flue gases than pass into the boiler 96 and the downstream device for flue gas treatment.

The disadvantages of conventional combustion are numerous:

1. Feeding is not continuously provided. The material to be burned, which falls in portions on the grate, causes a combustion bed of irregular height. In addition, lots of ashes and dust swirl up at each feeding. This hampers the fire and coats the boiler walls.

2. While the cooling of the non-water-cooled grates is performed by the primary air, the functions of cooling and primary air are not separated. Metering of the primary air supply is greatly limited by the cooling requirements and the operation therefore takes place with too great an oxygen surplus. The excess oxygen causes an unnecessarily large $NO_x$ content and, because too much air flows through the grate, it contributes to swirling and dust creation above the grate with all the undesirable results. Combustion is not optimal and the boiler walls are coated.

3. Because it is not possible to separate the functions of stoking and conveying on conventional grates, the combustion bed cannot be leveled and it is correspondingly not possible to achieve an even approximate geometric fire. Inevitably, there are always areas of the grate not covered with material to be burned and otherwise those on which the combustion bed is too high.

4. Because the types and number of the control parameters in conventional, non-water cooled grates are very limited, combustion can only be influenced to a very modest degree.

Figure 7:
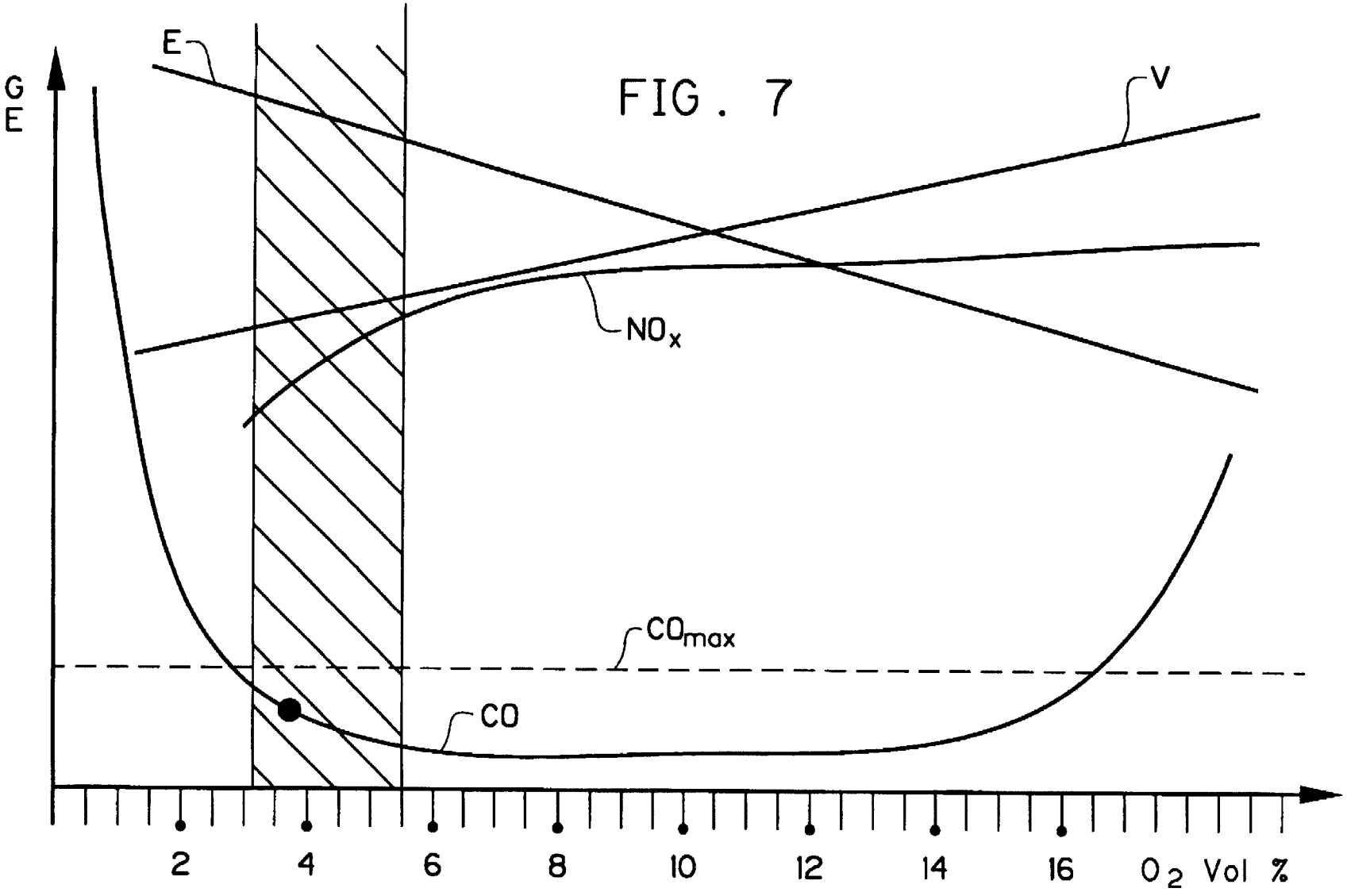
FIG. 7 is a diagram showing combustion quality criteria, i.e. the flue gases G and the system efficiency E as a function of the $O_2$ proportion in the flue gas G.

FIG. 7 shows a diagram for judging the combustion quality, that is the flue gases G and the installation efficiency E as a function of the $O_2$ portion in the flue gas. The CO value is considered to be an overriding measure of the combustion quality. From this diagram, it is possible to see that the CO threshold values ($CO_{max}$) are maintained over a relative wide range of the $O_2$ portion of the flue gas. The $NO_x$ portion also diminishes with the diminishing $O_2$ portion and the efficiency E of the combustion installation increases along with a simultaneously decreasing gas volume stream V. However, if the $O_2$ portion is further reduced past a defined amount, the CO value suddenly climbs steeply. It must, therefore, be the aim of the combustion control to keep the $O_2$ value so low that the $NO_x$ portion becomes minimal and that at the same time the CO threshold value is just being maintained. Such an ideal operating point is indicated in the diagram. In addition to the flue gas values achieved, it assures a very high installation efficiency. Because of the $O_2$ portion, which in comparison with values achieved at present is low, less air needs to be blown through the material to be burned. As a result, there is less dust generation. In addition, the dust particles are slower. This reduces the erosion of the boiler walls. Large quantities of fast-moving dust particles treat the boiler walls like sand blasting. The specific goal of the present process is the achievement of combustion which is as stoichiometric as possible. In addition, the $O_2$ portion in the flue gas is reduced to around 4 volume percent, in contrast to present installations which necessarily operate at approximately 10 volume percent.

The process in accordance with this invention for attaining these objects is described and explained below: The process comprises determining the actual fire data from the returned cooling energy and using these data for controlling and regulating the fire. Depending on the data, stoking and/or conveying and/or the supply of the grate with fresh material is then performed exactly in accordance with the preset control and regulation as needed, either at different times or simultaneously. Stoking can be limited completely locally to individual or several grate plates and the stoking strokes and the stroke speeds are variable, and, so too, the stroke frequencies. Furthermore, this grate construction allows, in cooperation with the control and regulation, supplying of the primary air as needed in metered amounts, time-dependent and exactly aimed to discrete locations on each grate stage. Due to this directed primary air supply, the material to be burned is optimally supplied with primary air, its heating value is best utilized and its combustion takes place as completely as possible. It is additionally possible for this purpose to determine the temperature spectrum in the combustion chamber above the fire grate using a plurality of temperature measuring sensors. For example, these measuring sensors can be installed in the surface of the grate plates. On the other hand, it is also possible to determine the temperature spectrum using a pyrometer. The directed metering of the primary air supply for each individual supply line allows the actual temperature spectrum in the combustion chamber to be maintained close to the optimal spectrum. Solenoid valves, for example can be used in the supply lines for the individual control of the primary air supply in each supply line, which solenoid valves are controlled by a central microprocessor in which the optimum temperature spectrum can be stored. As mentioned, the returned cooling energy is used as a regulating parameter on the basis of the flow-through and the temperature in the return lines. A control circuit can be established by the continuous measuring of the real spectrum and comparison with the ideal spectrum, in accordance with which the individual solenoid valves are separately metered very specifically and are opened slightly more or less to control primary air flow through the individual supply lines. The primary air supply is provided by one or more efficient compressors or fans. In this way, it is possible to build a specific and very complex regulating installation, which with electronic evaluation optimally assures the combustion by the individual control of all cooling media flows, all drive elements for moving and feeding the grate as well as all individual primary air supplies. As a result, it is possible to utilize the energy contents of the material to be burned even better, downward slag penetration is further minimized and above all, the basis for further minimizing the undesired flue gas components is provided.

The medium employed for maintaining the desired temperature can be provided with a heat exchange capability with the primary air to be supplied. A commercially available heat exchanger operating on a counter-flow principle can be used for this purpose. With such a heat exchanger, it is possible, for example, to preheat the primary air, which is advantageous for the optimum combustion of certain materials to be burned. With organic components of the garbage in particular, for example vegetables or fruit starting to rot or already rotted, preheating of the primary air is very much desired since it improves combustion. On the other hand, it is also possible to heat the fire grate before starting a combustion process in order to bring the grate as rapidly as possible to the optimum operating temperature. For this purpose, the medium for providing the desired temperature can remove the heat from the combustion products and convey it into the grate plates of the fire grate.

In respect to the primary air supply, it is of particular importance that cooling of the sliding fire grate is exclusively provided by a cooling liquid and the primary air supplied is exclusively effective combustion air, except for an unavoidable part of its cooling effects. As a result, in accordance with one embodiment of this invention, it is possible to meter combustion-aiding substances in a directed manner to the primary air, or it can be exclusively composed of such substances. Theoretically, the combustion air could be limited to pure oxygen, which is then directedly supplied through the primary air feed lines 41 to the material to be burned on the grate. It is immediately clear that in this manner, the air throughput can reduced to one fifth of the mount of air up to now. This means that such large amounts of air no longer flow at great speed and locally uncontrolled through the grate and the material to be burned; instead, oxygen is locally supplied in directed amounts to the material to be burned very gently, i.e. at low flow speeds. Thus, no unnecessary amounts of flue gas are generated, the flue gas speed is considerably reduced and thus also the occurrence of fly ash. In addition, the small amount of fly ash is no longer swirled up in the boiler. Consequently, the size of the boiler and all downstream located installation components can be smaller and therefore more cost-efficient. Nitrogen scrubbing in the course of the flue gas treatment may be completely omitted when supplying pure oxygen. It is possible in principle to meter oxygen, for example, in suitable amounts to the primary air which is to be used exclusively as combustion air. The higher the oxygen content of the primary air, the lower the required air throughput for achieving the desired final combustion. If, for example, there is an air throughput of 50,000 $m^3$ per hour in a conventional installation, approximately 5,000 $m^3$ of the approximately 10,000 $m^3$ of oxygen contained therein are available for combustion and approximately 5,000 $m^3$ as combustion reserve. If, with the same quality of combustion, it is desired to reduce this air throughput by one half, the following approximate calculation results: there are still 5,000 $m^3$ of oxygen in 25,000 $m^3$ of ambient air, of which again approximately 2,500 $m^3$ are available for combustion and 2,500 $m^3$ as combustion reserve. By further metering in of approximately 5,000 $m^3$ of gaseous oxygen, it is possible to achieve the required values for the desired final combustion and the required combustion reserve. The 5,000 $m^3$ of oxygen per hour approximately correspond to 6,000 liters of liquid oxygen. This would therefore be 6,840 kg of liquid oxygen. It is now possible to calculate the cost/profit ratio of the addition of metered oxygen. Depending on the installation-specific criteria, the optimum may lie between zero and 100% of added oxygen. In any case, it is possible by means of an appropriate addition located on such a characteristic curve to make enormously great achievements: there is a much reduced flue gas volume, a clearly reduced flue gas speed is achieved, much less fly ash and, as a result of this the entire boiler layout and the nitrogen scrubbing and flue gas cleaning in particular can have much smaller dimensions. The reduction of these dimensions becomes apparent in reduced amortization costs and therefore reduced operating costs. However, a portion of this cost reduction is used up by the expense of adding these combustion-aiding substances, but upon balance it is possible to achieve very considerable savings.

It is possible to achieve and maintain a combustion bed of even height by means of the movable grate plates of continuously variable speed. The control of the grate plates can also be controlled by the temperature. As soon as the temperature of a grate plate or a section of a grate plate rises, this indicates that the combustion bed height there is too low or that even no material lies on this grate plate location. It is possible by means of appropriate automatically started stoking to immediately even out the combustion bed. The control measures mentioned here are advantageously performed by a microprocessor, wherein the temperature of the individual cooling medium returns, among others, are calculated as regulating variables. They rapidly indicate a change in the fire on the corresponding grate section.

Figure 8:
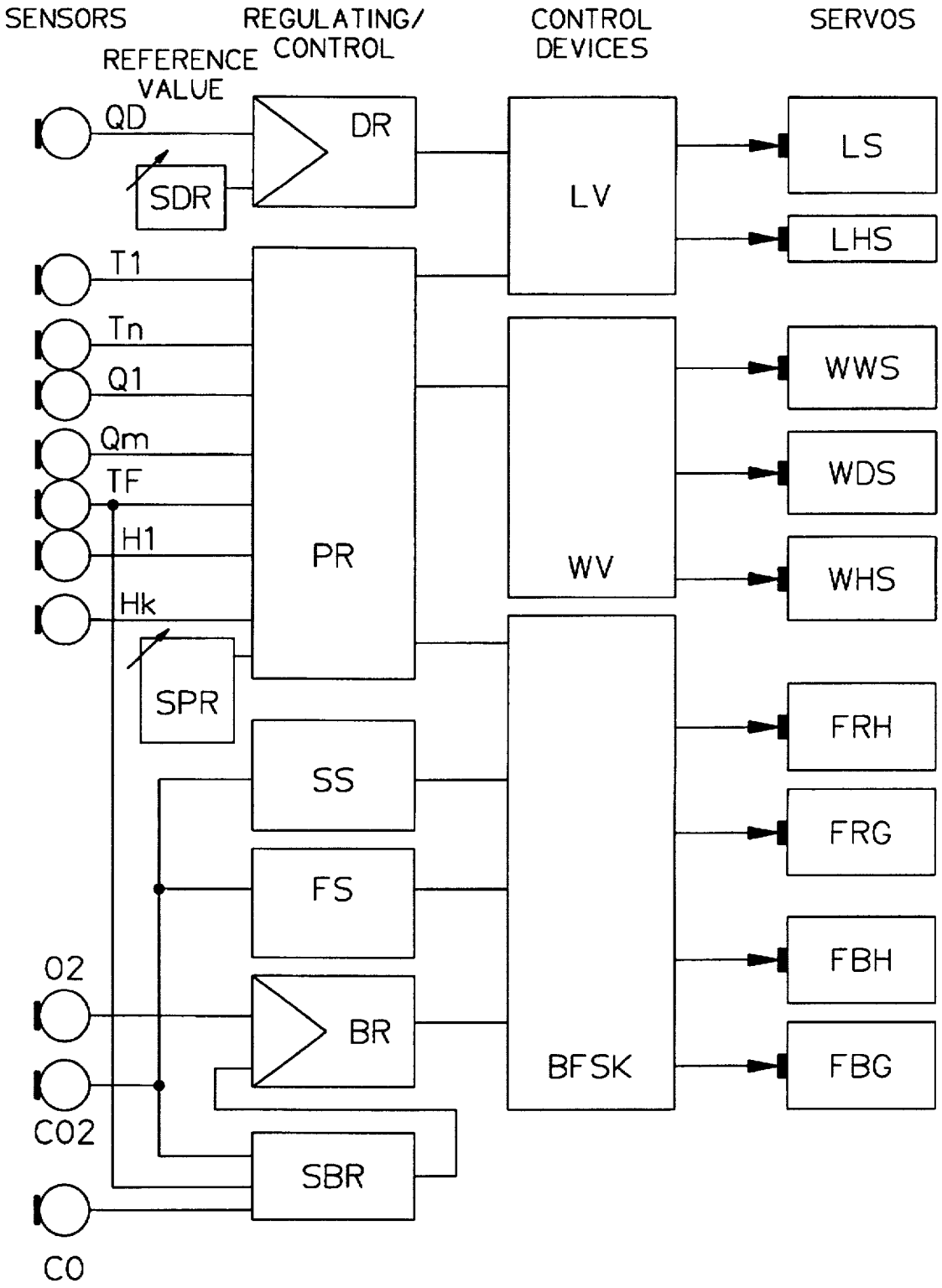
FIG. 8 is a block diagram of a control and regulating system for operating the process of this invention.

FIG. 8 shows the basic block diagram of a control and regulation for the process of the invention. This control and regulation comprises the following partial systems, which are each shown in a column: the sensor system is indicated at the extreme left, that is all detectable data are organized on the basis of the associated sensors. The column adjoining it on the right lists the reference value transmitters. This is followed by the actual regulation and control of the individual physical components of the entire combustion installation. The next column to the right identifies the devices for realizing priority links, and finally the column at the extreme right consists of a listing of the individual servo components.

The individual system components are described from the top to the bottom: with the sensors this starts with those for detecting the amounts of steam QD, they are followed by those for measuring the temperatures $T_1 \ldots T_n$ of the cooling water at the individual measuring points i. The flow-through amount $Q_1 \ldots Q_m$ in each return i is furthermore measured. The temperature TF in the combustion chamber is measured by a pyrometer, for example. It is optionally possible to measure the combustion bed height $H_1$ $H_k$ at different points i. An ultrasound measurement of the grate surface from above can be used for this, for example. $O_2$ means the oxygen content in the flue gas, which is measured with special measuring sensors or, in place of the $O_2$, the inverse value of carbon dioxide $CO_2$ in the flue gas is measured. Finally, the amount of carbon monoxide CO in the flue gas is also measured, which is prescribed by the law makers as the maximum value for a combustion installation to be operated. All values measured in this way are compared with the reference values listed in the second column. These are first the reference steam amount, which is calculated from the layout of the installation per se but which, as shown by experience, in actuality is the result of the maximum for each material to be burned in the form of a theoretically optimal preset value SDR (=reference value transmitter for the steam amount). Then the optimal values for the cooling water temperatures $T_1 \ldots T_n$ of the individual return lines i, those for the optimal flow-through values $Q_1 \ldots Q_m$ of the individual return lines i and the optimal combustion bed heights $H_1 \ldots H_k$ of the individual grate plates i are provided. These values provide defined reference values for a profile SPR (=reference value transmitter profile). The individual regulating and control units are listed in the third column, which link the measured data with the reference values and pass them on to the priority links for calculation. The third column starts at the top with the steam regulator DR. It compares the detected effective amount of steam with the reference steam amount. The temperatures $T_i$, flow-through amounts $Q_i$ and, if required, the combustion chamber temperature TF and the combustion bed heights $H_i$ are entered into the profile regulator PR. The measured values for $O_2$ or $CO_2$ are used as parameters for the stoking control SS, the conveying control FS and the feed regulator BR. The combustion chamber temperature TF and the measured $O_2$ or $CO_2$ values in the flue gas as well as the CO value in the flue gas are entered into the minimizing computer SBR for the ratio of $O_2$ to $CO_2$. The calculated value affects the feed regulator, too. The output signals of these regulators are linked to each other in the control devices listed in the fourth column and are further processed. The block diagram provides the following priority linking options listed in this fourth column. Starting at the top is the air distributor LV which is fed by the output signals of the steam regulator DR and the profile regulator PR. Then follows the cooling water energy distributor WV, which receives its data from the profile regulator PR. Then follows a coordinating computer BFSK for coordinating the feed, conveying and stoking movements. The individual linkages performed by calculations on the basis of programs then control the servo components. Thus, the air distributor acts as the determinant for the air system and/or, if required, also for the air heating system, namely in case the primary air is to be preheated, or if preheated air is to be supplied for drying the material to be burned.

Cooling water management is performed by the cooling water distributor WV by setting the directional control valves WWS for the various returns of the cooling water system, by the metered supply of the freshly fed-in cooling water by means of the metering unit WDS and by finally setting the heating system for the cooling water WHS, depending on whether and to what degree the temperature of the cooling water is adjusted.

The coordinating computer BFSK sets the drive elements for the grate movements and for feeding the grate. These comprise the conveying drives for determining the stroke FRH of the individual cylinder-piston units of the movable grate plates and the conveying drives for determining the stroke speeds FRG of the individual cylinder-piston units of the movable grate plates. In the same way, feeding is also set via the conveying drives for the stroke FBH and the stroke speed FBG of the feed installation. Feeding can occur continuously, in that first the solids in the feed conduit are made into portions and held back by hydraulic blocking grids which can be moved in at different levels, so that only just one such portion of solids lies on the feed installation. The lock opening to the combustion chamber which must be passed through is then always tightly closed by the solids portion and continuous feeding to the fire grate through this opening becomes possible. This continuous feeding is possible because the support surface of the feed installation is formed by a plurality of longitudinal bars, which convey the solids resting on them evenly through the opening to the fire grate by means of alternating slow strokes which, viewed from the side, describe a rhomboid.

The following different control and regulation work is performed by means of these different partial systems:

1. Steam regulation by means of air distribution
2. $O_2$ or $CO_2$ regulation inverse to it, namely as
2.1-feed control, and/or
2.2-conveying control, and/or
2.3-stoking control
3. Final gas combustion control by means of minimizing $CO/O_2$
4. Control of the combustion position, namely as
4.1-control of the primary air distribution, and/or
4.2-control of the cooling water energy redistribution
5. Garbage bed profile control.

The individual regulating systems are explained in sequence below:

1. Steam regulation by means of air distribution

Steam regulation is realized via the sensor QD for the steam amount, the reference value transmitter SDR, the steam regulator DR and by means of an air distributor LV via the air system LS. The regulating system for the regulator is the entire grate, the regulating variable is the steam output or a value connected with the steam output. The control variable is also the steam output or a value connected therewith. The amount of primary air with constant distribution acts as the regulated quantity and the individual servo components of the primary air system which primary air zone underneath the grate plates act as servo components. The following generally applies: the smaller the measured steam output in comparison with the reference value, the more primary air must be supplied.

2. $O_2$ or $CO_2$ regulation inverse to it

A further essential regulating system contains the $O_2/CO_2$ regulation. These two values are inverse in relation to each other. In many cases, the $O_2$ portion in the flue gas is measured. The $O_2/CO_2$ regulation is realized by means of a sensor for the $O_2$ and/or $CO_2$ values, a reference value transmitter SBR, a feed regulator BR and a conveying control FS, a stoking control SS and via a coordinator BFSK for the grate conveying drives FRH and FRG as well as the feed conveying drives FBH and FBG.

2.1 Feed control

The regulating system for the conveying regulator BR is the feed installation and/or the portioning installation. The regulating and control variable is the $O_2$ and/or $CO_2$ content and the regulated quantity for this is the stroke length and the stroke speed of the individual movable feed elements for the continuous feeding of the grate. In this case, the servo components contain the drive systems for these strokes.

2.2 Conveying control

In the conveying control, the control system contains all movable grate plates. The $O_2$ and/or $CO_2$ content is used as a regulating and control variable and regulated quantities are the stroke length and the stroke speed of the individual movable grate plates.

2.3 Stoking control

In the stoking control SS, the control system again contains all movable grate plates. The $O_2$ and/or $CO_2$ content is used as the control and regulating variable and the regulated quantities for this are again the reduced stroke lengths and the stroke speeds of the individual movable grate plates. If, for example, the $CO_2$ content begins to fall or the $O_2$ content in the flue gas which is inverse thereto begins to rise, stoking commences. If this stoking does not bring relief, the system is aware that no material to be burned lies on the grate in that location. It is therefore necessary to convey material to be burned.

The coordinator BFSK has the task to switch the movements to be performed by the stoking control SS, conveying control FS and/or the feed regulation BR separately and/or superimposed on each other, simultaneously or sequentially into the servo elements of the servo components.

3. Final gas combustion control by means of minimizing $CO/O_2$

The final gas combustion is a very important value for each garbage burning installation. It is possible by means of the process in accordance with this invention to regulate this very specifically, namely via the chain of the feed regulation through the $CO/O_2$ minimizing computer SBR as the reference value transmitter for the feed regulator BR. Most garbage burning installations are operated with a volume portion of approximately 10% oxygen in the flue gas. This air surplus is necessary for assuring the final flue gas combustion in conventional systems. In the process, it must be tolerated that the $NO_x$ value is high in this type of operation. The ratio between CO and $NO_x$ is opposed and optimal only in a narrow $O_2$ range. The $CO/O_2$ minimizing computer automatically approaches the lowest possible $O_2$ content in which an almost complete final gas combustion is assured. Up to now it would already have been possible to lower the $NO_x$ value, only it was not possible at the same time to assure by means of the present regulating and air distributing options that the CO value was still maintained at a lower $CO_2$ content. Now the present process in accordance with this invention makes it possible to lower the $O_2$ content in the flue gas and to approach an optimal operating point of the combustion thanks to the specific regulating installation. This operating point is characterized by a lower $O_2$ value with a simultaneous clear reduction of the $NO_x$ portion, and all this with the assured maintenance of the permissible CO value, even at a clear reduction of this CO value. To reach this operating point, the reference value transmitter reduces the $O_2$ reference value for the feed regulator long enough so that the actual CO value of the raw gases with a minimal $O_2$ value lies below the lawfully permissible CO reference value. At a maximum value, the combustion chamber temperature simultaneously monitored via the temperature sensor TF limits a further reduction of the $O_2$ content. In this case, the regulating system for the final gas combustion regulation is the feed and positioning installation, and the regulating variable is the $O_2$ and/or the $CO_2$ content. The ratio between CO and $O_2$ is used as the control variable. The stroke speed and/or the stroke length of the servo components, namely the feed installation and/or the movable grate plates, are used as the regulated quantity.

4. Control of the combustion position

The combustion positioning is a further variable in comparison with the processes operated by conventional installations. This combustion positioning is realized via the temperature sensors $T_1 \ldots T_n$ for the cooling water temperatures of the grate, via the flow-through amount transmitters $Q_1 \ldots Q_m$ of the flow-through amounts of the grate, via the temperature sensor TF of the combustion chamber temperature, via a cooling water energy distributor WV, via a cooling water distribution system WWS, a cooling water metering system WDS, a cooling water heater on the one hand and/or via the air distributor LV, the air system LS and an air heater LHS on the other hand as the primary air distribution regulation and/or the cooling water energy redistribution control.

4.1 Control of the primary air distribution

The control systems for the primary air distribution control are the primary air zones which, however, can be subdivided in themselves into local areas on the grate plates by means of a plurality of feed air nozzles. The actuating variable is the primary air distribution, i.e. how much air gets to what point at what time. The control variable is given by the ideal temperature profile of the cooling water. The amounts of air for the individual primary air zones or to the individual feed air nozzles are used as regulated quantities for this. The servo components to be operated are the drives for the primary air supply, which consist of compressors or fans, and/or an air heater. If, for example, the cooling water temperature in the final combustion zone of the grate does not sink in respect to the main combustion zone, primary air is also supplied there, something which otherwise is not done.

4.2 Control of the cooling water energy redistribution

The control system for cooling water energy redistribution is the grate cooling system, and the actuating variable is the cooling water energy distribution. The optimum cooling water energy profile is used as the control variable. In this case the regulated quantity is the cooling water path and/or the cooling water amount and/or the cooling water energy. The drives of the cooling water path system and/or of the cooling water metering system and/or of a cooling water heater are used as the servo components to be operated.

5. Garbage bed profile control

The instant process also opens a possibility of controlling even the profile of the garbage or combustion bed. This is realized by means of the temperature sensors $T_1 \ldots T_n$ for the cooling water temperature of the grate, the temperature sensor TF for the combustion chamber temperature, the garbage or combustion bed height sensors $H_1 \ldots H_k$, the profile computer PR and the coordination computer BFSK, the grate conveying drives FRH and FRG as well as the feed drives FBH and FBG. The control system in this case is the grate conveying and feed system. The actuating variable is the garbage bed profile. The control variable is given by the cooling water temperature profile and/or the directly measured garbage bed profile. The stroke length and the stroke speeds of the feed and the movable grate plates, which constitute the servo components, act as regulated quantities.

In the minimal case, a control is only realized by means of the return flow temperatures of the cooling medium, which are then calculated as regulated quantities for the movements of the grate plates. Stoking of the respective grate plate is started in case of locally falling temperatures and, if the temperature does not rise again, additional material to be burned is conveyed to this spot by increasing the strokes. As a further option more primary air is supplied to this spot until the reference temperature has been reached.

It is clear that with an increasing number of parameters the regulating network becomes very complex. However, the goal always is to achieve a combustion which is as stoichiometric as possible. It is of great importance that by the instant process it is possible to gather experience in practical operation immediately, which in a short time results in the ability to drastically reduce the flue gas volumes so that the downstream arranged units for the treatment of flue gas can be designed smaller and more cost-efficient. Furthermore, the boiler efficiency will increase because of the combustion optimized by the process, boiler erosion will be reduced because of the improved final combustion achieved and the flue gas values will level out at generally lower values. The disposition of filtered ashes which are filtered out of the flue gas becomes increasingly more expensive. For this reason, it is important to reduce the yield of filter ashes, which is achieved with the instant process by improved combustion.

We claim:

1. In a process for burning solids on a sliding fire grate system comprising a plurality of grate plates through which a cooling liquid flows separately and half of which grate plates are individually movable, the improvement comprising:

cooling at least one of said plurality of grate plates, individually supplying primary air to at least one of said grate plates, wherein combustion-enhancing materials are directedly metered into each said individual supply of primary air, as necessary, applying stoking movements individually and timed to each of the grate plates, applying conveying movements individually and timed to each of the grate plates, and applying timed feed movements for feeding the grate plates, wherein at least the cooling liquid temperatures of the individual grate plates are used as control variables for the control of said sliding fire grate system.

2. A process in accordance with claim 1, wherein the cooling liquid temperatures of the individual grate plates are used as control variables for controlling the stoking and conveying movements of the individually movable grate plates, which are timed and locally independent of each other, the feed movements and the primary air supply, which is timed and individually metered and supplied separately to each grate plate.

3. A process in accordance with claim 2, wherein by varying the stoking, conveying and feed movements, a cooling water temperature distribution is approximated to a theoretical ideal, and, while maintaining said cooling water temperature distribution as close as possible, the primary air supply is reduced while maintaining a prescribed CO threshold value and reduction in $NO_x$ value until the CO value begins to rise, whereby an operating point below the CO threshold value is defined, which is afterwards maintained by varying all possible parameters.

4. A process in accordance with claim 3, wherein, in case of a falling cooling water temperature of one grate plate, stoking movement is immediately started at said grate plate and, if the cooling water temperature does not increase thereafter, primary air supply to said grate plate is increased and, if the cooling water temperature still does not increase after said stoking movement, said conveying movement is started in order to convey material to be burned to the respective grate plate, such that when a reference value of the cooling water temperature has been reached, the conveying movement is stopped and the primary air supply is returned to an initial value.

5. A process in accordance with claim 4, further comprising detecting data of returned cooling energy and using said data for controlling and regulating combustion;

feeding of the grate as necessary timed separated from the stoking and conveying of the material to be burned on the grate in accordance with the setting of the control and regulation;

timed and individually separately stoking and conveying the material to be burned onto the grate as necessary in accordance with the setting of the control and regulation;

directing a supply of primary air as necessary to discrete locations on each grate plate, each in metered amounts and lengths of time; and adjusting the individual temperature of each grate plate of the fire grate using the medium flowing through it.

6. A process in accordance with claim 5, wherein fire data are determined by a plurality of temperature sensors ($T_1 \ldots T_n$), a plurality of flow-through measuring devices ($Q_1 \ldots Q^m$) and a plurality of measuring devices ($H_1 \ldots H_k$) for determining local garbage bed height, and by a combustion chamber thermometer (TF), and are subsequently entered in a temperature, energy and garbage bed profile computer (PR);

feeding is controlled by a coordination computer (BFSK), which receives its data from the profile computer (PR) and a feed regulator (BR), which take into consideration the ratio of $O_2$ to CO in the flue gas, by varying the stroke and the stroke speed of the feed installation;

the timed and individually separated stoking and/or conveying of the material to be burned on the grate is controlled by a variation of the stroke and the stroke speed of the grate plate drives by said coordination computer (BFSK), which receives its data from the profile computer (PR), and from a stoking (SS) and conveying control (FS) which take into consideration the ratio of $O_2$ to CO in the flue gas;

the directed supply of primary air over a plurality of zones in said system, each with separate air supply nozzles, occurs in the grate plates, wherein the respectively supplied amount of air is controlled by an air distributor (LV), which takes into consideration the data of a steam regulator (DR), which makes comparison between a reference value of the amount of steam and an effectively generated value; and the separate grate plates are individually temperature-adjusted whereby a cooling water distributor (WV) controls at least one directional control valve (WWS) of the individual liquid circuits of the individual grate plates, so that freshly supplied cooling liquid is metered in or cooling liquid is heated, as necessary, wherein the regulated quantities are set by the temperature, energy and garbage bed profile computer PR.

7. A process in accordance with claim 6, wherein for the stoking, conveying and feed movements, the respective stroke, stroke speeds and stroke frequencies are varied respectively independently of each other and timed and individually separated.

8. A process in accordance with claim 7, wherein operation in a drying zone of the grate system is run without any supply of primary air and cooling of the grate system is exclusively provided by a medium flowing through it.

9. A process in accordance with claim 8, wherein in a final combustion zone of the grate system, the operation is run substantially without primary air supply, primary air being supplied only if the cooling water temperature from the final combustion zone does not fall below the cooling water temperature in a main combustion zone of the grate system, the supply of primary air being stopped as soon as the cooling water temperature from the final combustion zone drops.

10. A process in accordance with claim 9, wherein pure oxygen is admixed with the primary air.

11. A process in accordance with claim 1, wherein by varying the stoking, conveying and feed movements, a cooling water temperature distribution is approximated to a theoretical ideal, and, while maintaining said cooling water temperature distribution as close as possible, the primary air supply is reduced while maintaining a prescribed CO threshold value and reduction in $NO_x$ value until the CO value begins to rise, whereby an operating point below the CO threshold value is defined, which is afterwards maintained by varying all possible parameters.

12. A process in accordance with claim 1, wherein, in case of a falling cooling water temperature of one grate plate, stoking movement is immediately started at said grate plate and, if the cooling water temperature does not increase thereafter, primary air supply to said grate plate is increased and, if the cooling water temperature still does not increase after said stoking movement, said conveying movement is started in order to convey material to be burned to the respective grate plate, such that when a reference value of the cooling water temperature has been reached, the conveying movement is stopped and the primary air supply is returned to an initial value.

13. A process in accordance with claim 1, further comprising detecting data of returned cooling energy and using said data for controlling and regulating combustion;

feeding of the grate as necessary timed separated from the stoking and conveying of the material to be burned on the grate in accordance with the setting of the control and regulation;

timed and individually separately stoking and conveying the material to be burned onto the grate as necessary in accordance with the setting of the control and regulation;

directing a supply of primary air as necessary to discrete locations on each grate plate, each in metered amounts and lengths of time; and adjusting the individual temperature of each grate plate of the fire grate using the medium flowing through it.

14. A process in accordance with claim 1, wherein fire data are determined by a plurality of temperature sensors ($T_1 \ldots T_n$), a plurality of flow-through measuring devices ($Q_1 \ldots Q_m$) and a plurality of measuring devices ($H_1 \ldots H_k$) for determining local garbage bed height, and by a combustion chamber thermometer (TF), and are subsequently entered in a temperature, energy and garbage bed profile computer (PR);

feeding is controlled by a coordination computer (BFSK), which receives its data from the profile computer (PR) and a feed regulator (BR), which take into consideration the ratio of $O_2$ to CO in the flue gas, by varying the stroke and the stroke speed of the feed installation;

the sequentially and individually separated stoking and/or conveying of the material to be burned on the grate is controlled by a variation of the stroke and the stroke speed of the grate plate drives by said coordination computer (BFSK), which receives its data from the profile computer (PR), and from a stoking (SS) and conveying control (FS) which take into consideration the ratio of $O_2$ to CO in the flue gas;

the directed supply of primary air over a plurality of zones in said system, each with separate air supply nozzles, occurs in the grate plates, wherein the respectively supplied amount of air is controlled by an air distributor (LV), which takes into consideration the data of a steam regulator (DR), which makes comparison between a reference value of the amount of steam and an effectively generated value; and the separate grate plates are individually temperature-adjusted whereby a cooling water distributor (WV) controls at least one directional control valve (WWS) of the individual liquid circuits of the individual grate plates, so that freshly supplied cooling liquid is metered in or cooling liquid is heated, as necessary, wherein the regulated quantities are set by the temperature, energy and garbage bed profile computer PR.

15. A process in accordance with claim 1, wherein for the stoking, conveying and feed movements, the respective stroke, stroke speeds and stroke frequencies are varied respectively independently of each other and timed and individually separated.

16. A process in accordance with claim 1, wherein operation in a drying zone of the grate system is run without any supply of primary air and cooling of the grate system is exclusively provided by a medium flowing through it.

17. A process in accordance with claim 1, wherein in a final combustion zone of the grate system, the operation is run substantially without primary air supply, primary air being supplied only if the cooling water temperature from the final combustion zone does not fall below the cooling water temperature in a main combustion zone of the grate system, the supply of primary air being stopped as soon as the cooling water temperature from the final combustion zone drops.

18. A process in accordance with claim 1, wherein pure oxygen is admixed with the primary air.

19. A process in accordance with claim 1, wherein the primary air is pure oxygen.

* * * * *